US010190387B2

(12) United States Patent
Hemmingsen et al.

(10) Patent No.: US 10,190,387 B2
(45) Date of Patent: Jan. 29, 2019

(54) METHOD OF SEALING A WELL

(71) Applicant: STATOIL PETROLEUM AS, Stavanger (NO)

(72) Inventors: Pål Viggo Hemmingsen, Trondheim (NO); Gjermund Grimsbo, Stavanger (NO); Alastair Buchanan, Stavanger (NO)

(73) Assignee: STATOIL PETROLEUM AS, Stavanger (NO)

( * ) Notice: Subject to any disclaimer, the term of this patent is extended or adjusted under 35 U.S.C. 154(b) by 191 days.

(21) Appl. No.: 15/024,268

(22) PCT Filed: Sep. 23, 2014

(86) PCT No.: PCT/EP2014/070279
§ 371 (c)(1),
(2) Date: Mar. 23, 2016

(87) PCT Pub. No.: WO2015/044151
PCT Pub. Date: Apr. 2, 2015

(65) Prior Publication Data

US 2016/0230499 A1 Aug. 11, 2016

(30) Foreign Application Priority Data

Sep. 25, 2013 (GB) ..... 1317000.6

(51) Int. Cl.

| | |
|---|---|
| ***E21B 33/13*** | (2006.01) |
| ***E21B 33/134*** | (2006.01) |
| ***E21B 17/00*** | (2006.01) |
| ***E21B 34/06*** | (2006.01) |

(52) U.S. Cl.
CPC ..... *E21B 33/13* (2013.01); *E21B 17/00* (2013.01); *E21B 33/134* (2013.01); *E21B 34/06* (2013.01)

(58) Field of Classification Search
None
See application file for complete search history.

(56) References Cited

U.S. PATENT DOCUMENTS

| | | | | |
|---|---|---|---|---|
| 3,324,017 | A * | 6/1967 | Perry | C08F 20/60 502/200 |
| 3,556,220 | A * | 1/1971 | Schwegman | E21B 33/1294 166/120 |
| 6,073,694 | A * | 6/2000 | Crawshaw | E21B 33/16 166/285 |
| 6,595,289 | B2 * | 7/2003 | Tumlin | E21B 33/134 166/177.4 |
| 2002/0023754 | A1 * | 2/2002 | Buytaert | E21B 33/138 166/313 |

(Continued)

FOREIGN PATENT DOCUMENTS

| | | |
|---|---|---|
| EP | 0346961 A2 | 12/1989 |
| GB | 2325479 A | 11/1998 |

(Continued)

*Primary Examiner* — Shane Bomar
(74) *Attorney, Agent, or Firm* — Birch, Stewart, Kolasch & Birch, LLP

(57) ABSTRACT

A method of sealing a well comprises creating one or more openings in a tubing installed in a wellbore, in a location for a well seal; using a wireline to locate a stinger in that location; setting the stinger in that location; and forming a seal in the well in that location, by injecting sealant through said stinger.

9 Claims, 2 Drawing Sheets

(56) References Cited

U.S. PATENT DOCUMENTS

| | | | | |
|---|---|---|---|---|
| 2002/0170713 | A1* | 11/2002 | Haugen | E21B 7/061 166/298 |
| 2003/0150614 | A1 | 8/2003 | Brown et al. | |
| 2006/0219407 | A1 | 10/2006 | Livingstone | |
| 2008/0190612 | A1* | 8/2008 | Buchanan | E21B 33/134 166/288 |
| 2009/0260817 | A1 | 10/2009 | Gambier et al. | |
| 2009/0280912 | A1* | 11/2009 | Buchanan | E21B 17/043 464/21 |
| 2010/0006282 | A1* | 1/2010 | Dirdal | E21B 21/08 166/250.07 |
| 2013/0319671 | A1* | 12/2013 | Lund | E21B 33/13 166/285 |
| 2015/0267500 | A1* | 9/2015 | Van Dongen | E21B 33/13 277/336 |

FOREIGN PATENT DOCUMENTS

| | | | |
|---|---|---|---|
| WO | WO 2006/053896 | A1 | 5/2006 |
| WO | WO 2012/105852 | A1 | 8/2012 |

* cited by examiner

METHOD OF SEALING A WELL

FIELD OF THE INVENTION

The present invention relates to a method of sealing a well. In particular embodiments, the method comprises installing a permanent fluid-tight barrier for well abandonment.

BACKGROUND TO THE INVENTION

Traditional plug and abandonment operations require that the entire production tubing and associated cabling is pulled from the wellbore prior to installation of a cement plug. However, the removal of the tubing is a costly and time-consuming exercise as it requires a drill rig on site. There also associated safety risks.

It is therefore an aim of the present invention to provide an alternative method of sealing a well which helps to address the afore-mentioned problems.

SUMMARY OF THE INVENTION

In accordance with a first aspect of the present invention there is provided a method of sealing a well comprising:

creating one or more openings in a tubing installed in a wellbore, in a location for a well seal;

using a wireline to locate a stinger in said location;

setting the stinger in said location; and forming a seal in the well in said location, by injecting sealant through said stinger.

Embodiments of the invention therefore provide a method for sealing a well which does not require the entire production tubing and control cables to be removed prior to forming a seal in the well. The method employs a wireline-conveyed stinger provided inside the tubing and arranged to extend over the interval provided with openings so that the sealant may flow out of the bottom end of the stinger and through the openings to seal the A-annulus between the tubing and adjacent casing. Conveniently, each step in the method may be performed using wireline and the method may be carried out whether or not control lines are originally present in the location for the well seal.

In certain embodiments, the method may further comprise removing any adjacent control lines in the location for the well seal.

It will be understood that, in practice, there will be heavy fluid in the A-annulus and in the tubing below the stinger and this will create a pressure differential causing the sealant which is pumped down an upper portion of tubing and through the stinger to flow upwards on exiting the stinger. If the method was employed without a stinger across the open section, the sealant would only flow through the upper openings due to the pressure from below. The provision of a stinger therefore ensures that the sealant is placed across the entire section of open tubing.

It will be understood that a stinger is normally a piece of tubular which is provided on a lowermost section of a tubing string to sting into another section of tubular (or a fluid or a seal) in order to perform a task such as sealing, pumping, verifying a location or opening valves etc. Alternatively, a small diameter tubing may be inserted along the entire length of the tubing. It is therefore an advantage of the present invention that the stinger is located only in the area of interest using wireline, thereby reducing the time and cost for the operation.

The stinger may have a fixed length or may be extendable. The length of the stinger may depend upon on the lubrication length available and/or the length of the interval to be sealed off.

In certain embodiments, the stinger may be telescopic. In which case, a plurality of telescopic sections may be held in a compacted configuration by a mechanism (e.g. shear screws, latches, detent rings, etc.) configured to release when a pre-determined pressure is applied, thus causing the telescopic sections to extend. Seals (e.g. O-rings or the like) may be provided between each telescopic section to ensure the joins are fluid-tight.

The telescopic stinger may comprise a valve across an end which is lowermost when the stinger is extended. The valve may be configured to adopt a closed position when fluid is pumped down into the stinger to apply pressure to the release mechanism to open each telescopic section. Once the stinger is suitably (e.g. fully) expanded, a greater pressure may be applied (e.g. above hat required to release the mechanism) in order to open the valve for pumping sealant into the tubing and casing.

The one or more openings may be formed by removing a relatively large section of the tubing (e.g. by milling). Alternatively, the one or more openings may be formed by slicing or perforating one or more holes in a section of the tubing.

The method may further comprise the use of a high viscous pill deployed through the stinger to clean the location before forming the seal.

Typically, the seal may be provided over an interval of approximately 50 m. Accordingly, the one or more openings may be provided over a similar length of interval and the stinger may also be of a similar length (when extended).

The step of setting the stinger in the location for the seal may comprise use of a packing element and slips to hang the stinger off the tubing at a position above the one or more openings.

The step of forming the seal may comprise forming a temporary or permanent plug in the well. The sealant may therefore comprise cement.

The method may further comprise providing a transverse support ledge in the tubing below the one or more openings so as to ensure that the sealant is retained within the location for the well seal (e.g. if the well pressure alone is not sufficient for this purpose).

According to a second aspect of the invention, there is provided a wireline-deployed stinger for use in the method according to the first aspect of the invention.

According to a third aspect of the invention, there is provided a telescopic stinger for use in the method according to the first aspect of the invention.

BRIEF DESCRIPTION OF THE DRAWINGS

Specific embodiments of the present invention will now be described with reference to the accompanying drawings, in which.

DETAILED DESCRIPTION OF CERTAIN EMBODIMENTS

FIGS. 1 to 5 illustrate various methods for sealing a well in accordance with embodiments of the present invention.

Figure 1:
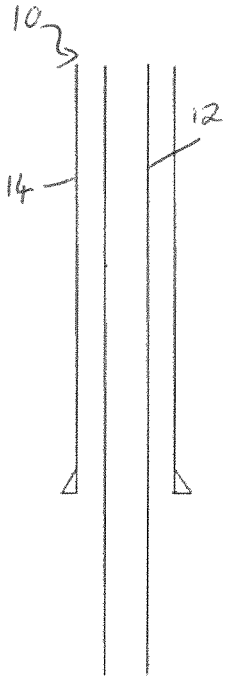
FIG. 1 shows a cross-sectional view of a portion of an inner casing and production tubing installed in a wellbore.

As shown in FIG. 1, a wellbore 10 is provided with a production tubing 12 extending through a casing 14 to form a so-called A-annulus there-between. One or more openings is created in the tubing 12, in a location X for a well seal, as illustrated in the alternative FIGS. 2A, 2B and 2C.

Figure 2A:
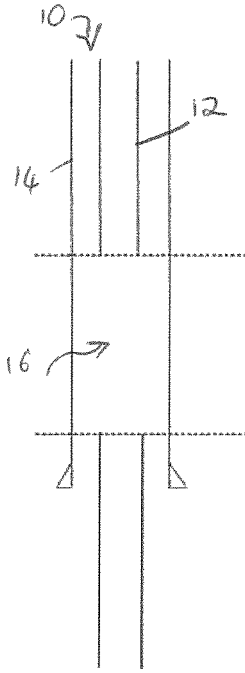
FIG. 2A shows the apparatus of FIG. 1 after a section of the tubing has been removed, in a location for a well seal, in accordance with a first embodiment of the invention.

FIG. 2A illustrates the case where a relatively large section of the tubing 12 has been removed to create a single opening 16 extending over the entire location X for the well seal, in accordance with one embodiment of the invention.

Figure 2B:
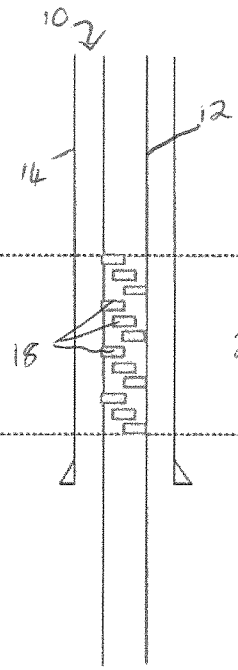
FIG. 2B shows the apparatus of FIG. 1 after a plurality of openings have been sliced in the tubing, in a location for a well seal, in accordance with a second embodiment of the invention.

FIG. 2B illustrates the case where a plurality of openings 18 have been sliced in the tubing 12, in the location X for the well seal, in accordance with another embodiment of the invention.

Figure 2C:
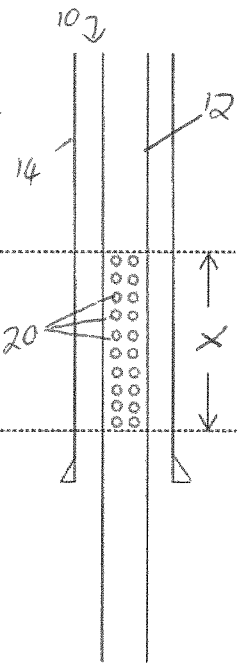
FIG. 2C shows the apparatus of FIG. 1 after a plurality of openings have been perforated or punched in the tubing, in a location for a well seal, in accordance with a third embodiment of the invention.

FIG. 2C illustrates the case where a plurality of openings 20 have been perforated or punched in the tubing 12, in the location X for the well seal, in accordance with a further embodiment of the invention.

Figure 3:
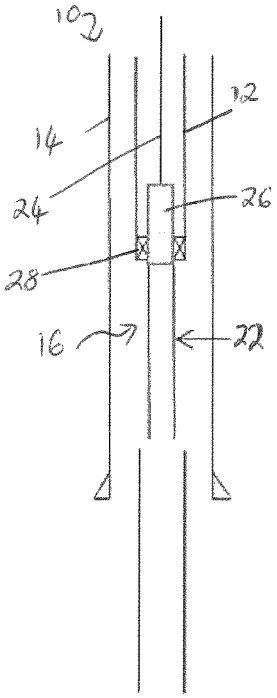
FIG. 3 shows a wireline-conveyed stinger being set across the location for the well seal in the tubing of FIG. 2A.

FIG. 3 shows a wireline-conveyed stinger 22 being set across the location X for the well seal, in the tubing 12 of FIG. 2A. Thus, the stinger 22 is hung from the tubing 12 above the opening 16 and extends downwardly over substantially the entire length of the opening 16. As shown in FIG. 3, the stinger 22 is installed in the tubing 12 using a wireline 24 and wireline attachment tool 26. The stinger 22 is then set in place using packing elements and slips 28 so that the wireline 24 and wireline attachment tool 26 can be removed from the wellbore 10.

Figure 4:
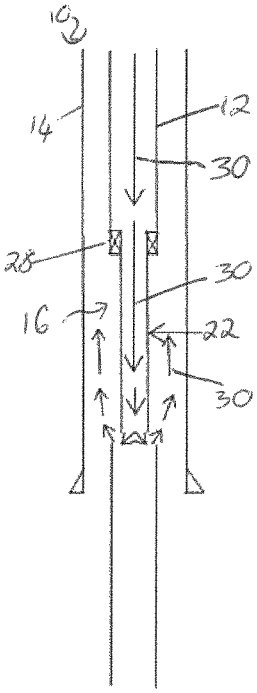
FIG. 4 shows the injection of a sealant through the stinger of FIG. 3.

As shown in FIG. 4, a sealant material 30 (e.g. cement) is then injected into the uppermost portion of tubing 12 and through the stinger 22. As explained above, due to typical well pressures in the tubing 12 and A-annulus, on exiting the lowermost end of the stinger 22, the sealant 30 flows upwardly around the stinger 22 and, due to the presence of the opening 16 also flows outwardly to fill the diameter of the casing 14.

Figure 5:
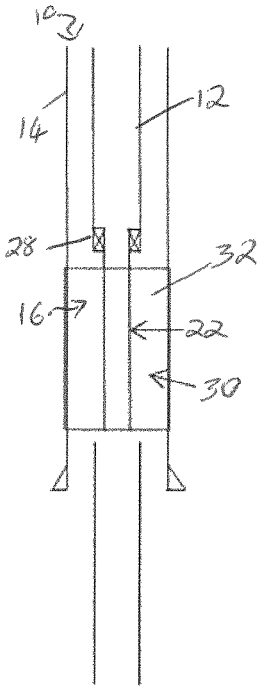
FIG. 5 shows the seal set in place in the wellbore.

FIG. 5 shows the sealant 30 after it has set in the location X to form a well seal 32 in the wellbore 10. It will be noted that the seal 32 forms a transverse plug across the wellbore 10 and completely fills the space both within the stinger 22 and surrounding the stinger 22 so as to encapsulate the stinger 22 in the plug in the location X.

Figures 6A, 6B, 6C, 6D:
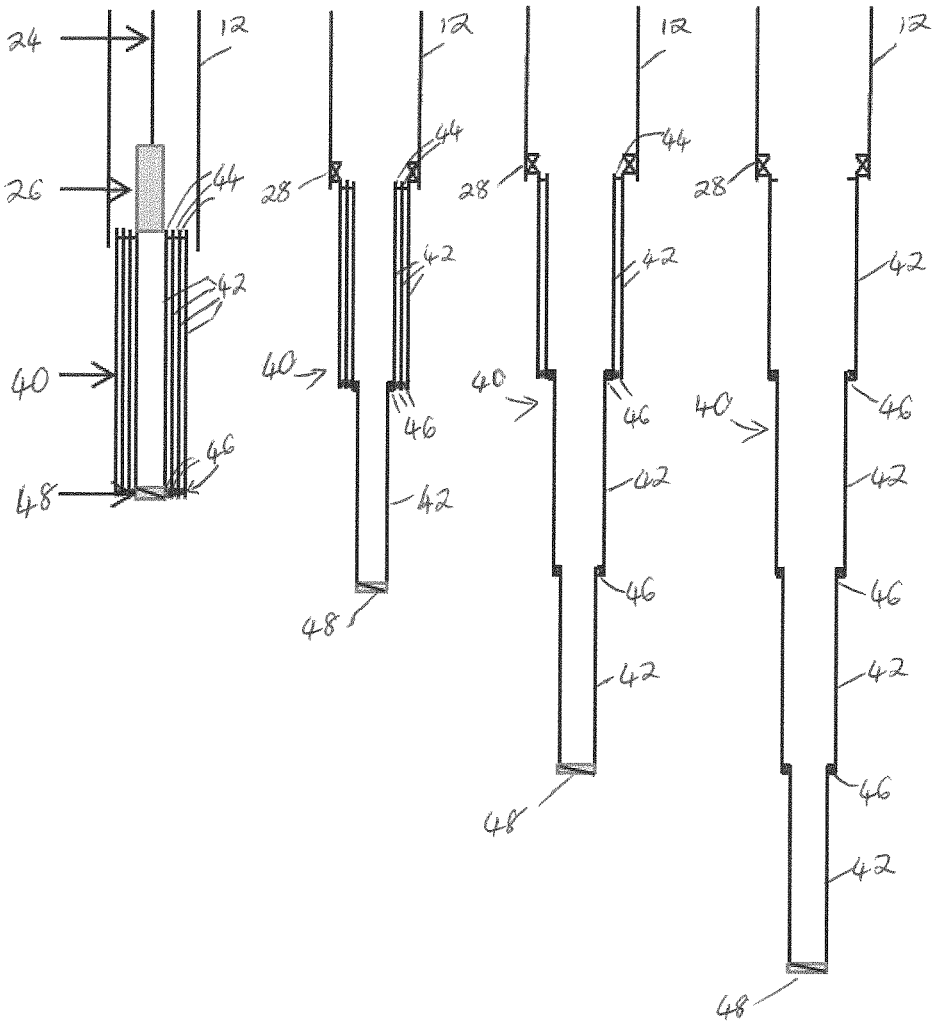
FIG. 6A shows a cross-sectional view of a telescopic stinger being located in a wellbore using wireline, in accordance with an embodiment of the invention.
FIG. 6B shows the telescopic stinger of FIG. 6A after its uppermost section has been set in the tubing and the innermost section has been expanded downwardly.
FIG. 6C shows the telescopic stinger of FIG. 6B after a second innermost section has been expanded downwardly.
FIG. 6D shows the telescopic stinger of FIG. 6C after a third innermost section has been expanded downwardly so as to fully expand the stinger in the tubing.

FIGS. 6A through 6D show a telescopic stinger 40 which can be employed instead of the stinger 22 in FIGS. 3 to 6. As shown in FIG. 6A, the telescopic stinger 40 comprises four telescopic sections 42 which are initially held in a compacted configuration by shear screws 44. The shear screws 44 are configured to break when a pre-determined pressure is applied, thus causing the telescopic sections 42 to extend one after the other as illustrated. Seals 46 are provided at the base of each telescopic section 42 to ensure the join with the telescopic section 42 below is fluid-tight when the stinger 40 is expanded.

A valve 48 is provided across an end which is lowermost when the stinger 40 is extended. The valve 48 is configured to adopt a closed position when fluid is pumped down into the stinger 40 so as to apply pressure to the shear screws 44 to open each telescopic section 42. Once the stinger 40 is fully expanded, a greater pressure is applied to open the valve 48 for pumping sealant 30 into the tubing 12 and casing 14 as per FIGS. 4 and 5.

It will be appreciated by persons skilled in the art that various modifications may be made to the above-described embodiments without departing from the scope of the present invention, as defined by the claims. It will also be appreciated that features described in relation to one embodiment may be mixed and matched with features of another embodiment.

The invention claimed is:

1. A method of sealing a well comprising:
   - creating one or more openings in a tubing installed in a wellbore, in a location for a well seal;
   - using a wireline to locate a stinger in said location;
   - setting the stinger in said location by hanging the stinger from said tubing; and
   - forming a seal in the well in said location, by injecting sealant through said stinger such that the sealant flows upwardly around the stinger,
   - wherein the stinger is extendable and telescopic,
   - wherein the stinger comprises a valve across an end which is lowermost when the stinger is extended, and
   - wherein a plurality of telescopic sections are held in a compacted configuration by a mechanism configured to release when a pre-determined pressure is applied, thus causing the telescopic sections to extend.

2. The method according to claim 1, wherein the valve is configured to adopt a closed position when fluid is pumped down into the stinger to apply pressure to the release mechanism to open each telescopic section.

3. The method according to claim 2, wherein, once the stinger is expanded, a pressure above that required to release the mechanism is applied in order to open the valve for pumping sealant out of the end of the stinger.

4. The method according to claim 1, wherein the one or more openings is formed by removing a section of the tubing.

5. The method according to claim 1, wherein the one or more openings is formed by slicing or perforating one or more holes in a section of the tubing.

6. The method according to claim 1, further comprising the use of a high viscous pill deployed through the stinger to clean the location before forming the seal.

7. The method according to claim 1, wherein the step of forming the seal comprises forming a permanent plug in the well.

8. The method according to claim 1, further comprising providing a transverse support ledge in the tubing below the one or more openings so as to ensure that the sealant is retained within the location for the well seal.

9. A telescopic stinger for use in the method according to claim 1.

* * * * *